US005727975A

United States Patent [19]

Wei et al.

[11] Patent Number: 5,727,975

[45] Date of Patent: Mar. 17, 1998

[54] ARC TUBE FOR ELECTRODELESS LAMP

[75] Inventors: George C. Wei, Weston, Mass.; Jerry Kramer, Yorktown Heights, N.Y.; John Walsh, Milford; Walter P. Lapatovich, Marlborough, both of Mass.

[73] Assignee: Osram Sylvania Inc., Danvers, Mass.

[21] Appl. No.: 726,718

[22] Filed: Oct. 7, 1996

Related U.S. Application Data

[62] Division of Ser. No. 509,851, Aug. 1, 1995, Pat. No. 5,621,275.

[51] Int. Cl.[6] ..... H01J 65/04; H01J 9/26

[52] U.S. Cl. ..... 445/22

[58] Field of Search ..... 445/22, 23

[56] References Cited

U.S. PATENT DOCUMENTS

| | | | |
|---|---|---|---|
| 3,026,210 | 3/1962 | Coble | 313/636 |
| 4,373,030 | 2/1983 | Kaneno et al. | 501/152 |
| 4,503,356 | 3/1985 | Kobayashi et al. | 445/22 X |
| 4,545,799 | 10/1985 | Rhodes et al. | 65/59.21 |
| 5,552,670 | 9/1996 | Heider et al. | 445/23 X |

*Primary Examiner*—Kenneth J. Ramsey
*Attorney, Agent, or Firm*—William H. McNeill

[57] ABSTRACT

An arc tube for an electrodeless metal halide discharge lamp has an arc chamber fabricated from a material selected from the group consisting of magnesia-doped polycrystalline alumina, silicon dioxide doped polycrystalline alumina and monocrystalline alumina. The arc chamber is tubular and has at least one end and has a given outside diameter. At least one end cap closes the at least one end of the arc chamber, the end cap being formed from magnesia-doped polycrystalline alumina and comprising a substantially cup-shaped member having an inside diameter which is sealed to the outside diameter of the arc chamber by a shrink-fit.

1 Claim, 2 Drawing Sheets

ARC TUBE FOR ELECTRODELESS LAMP

This is a division of application Ser. No. 509,851, filed Aug. 1, 1995, now U.S. Pat. No. 5,621,275.

TECHNICAL FIELD

This invention relates to arc discharge lamps and more particularly to an arc tube for an electrodeless lamp and to methods of making the same.

BACKGROUND ART

Electrodeless lamps are known; see, for example, U.S. Pat. Nos. 3,942,058; 4,427,924; 4,427,922; 4,783,615; and 4,810,938. Such lamps have been fabricated from quartz arc tubes. Greater efficiences could be realized if rare earth fills could be employed; however, to take advantage of some of these fill it is necessary, because of the low vapor pressure of some of the ingredients when in the iodide form, to increase the operating temperature of the arc tube to the point that the lifetime of the lamps using these arc tubes becomes too limited.

DISCLOSURE OF INVENTION

It is, therefore, an object of the invention to obviate the disadvantages of the prior art.

It is another object of the invention to enhance electrodeless lamps.

These objects are accomplished, in one aspect of the invention, by the provision of an arc tube for an electrodeless metal halide discharge lamp which comprises an arc chamber fabricated from a material selected from the group consisting of magnesia-doped polycrystalline alumina and mono-crystalline alumina. The arc chamber is tubular and has at least one end and has a given outside diameter. At least one end cap closes the at least one end of the arc chamber. The end cap comprises a substantially cup-shaped member having an inside diameter which is sealed to the outside diameter of the arc chamber by a shrink-fit.

The arc tube is fabricated by a method which comprises the steps of first forming from polycrystalline alumina doped with 0.08 weight percent magnesium oxide a green arc chamber having a substantially tubular configuration, and prefiring the green arc chamber at about 1350° C. for about 120 minutes in air. A sealing disc is formed to fit inside one end of the arc chamber, the sealing disc being formed from polycrystalline alumina doped with 0.08 weight percent magnesium oxide. The disc is fired in air at 1200° C. for about 120 minutes and sintered in 92% $N_2$-8% $H_2$ at 1850° C. for about one minute. The sintered disc is inserted into an end of the arc chamber to form a first assembly and this first assembly is sintered at 1950° C. for about 30 minutes in an atmosphere of 92% $N_2$-8% $H_2$ to form an hermetic seal between the arc chamber and the disc. An end cap is formed from polycrystalline alumina doped with 0.08 weight percent magnesium oxide for sealing an open end of the arc chamber, the end cap being cup-shaped and having an inside diameter which is formed to fit over the outside diameter of the arc chamber. The end cap is prefired at 1200° C. for about 120 minutes in air. An arc generating and sustaining fill is introduced into the arc chamber, the end cap is fitted over the open end of the arc chamber to form a second assembly, and the second assembly is rapidly heated to about 1800° C. and held there for about one minute to form an interference-fit, hermetic bond between the end cap and the arc chamber to complete the arc tube.

BRIEF DISCRIPTION OF THE DRAWINGS

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
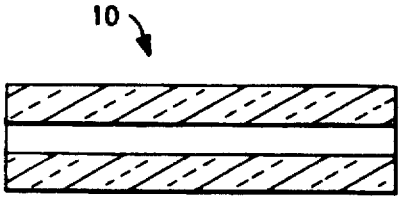
FIG. 1 is an elevational, sectional view of a component of the invention.
Figure 2:
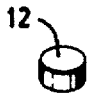
FIG. 2 is a perspective view of a disc used with the invention.
Figure 3:
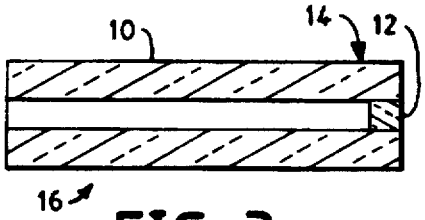
FIG. 3 is an elevational, sectional view of a step in the sealing operation.

Polycrystalline alumina (PCA) powder doped with 0.08 weight percent was compacted and fabricated to a small grain size (about 15 μm) with an equiaxed microstructure by known techniques into an open ended, green tube 10. These green tubes were prefired in air at about 1350° C. for about 120 minutes. Green PCA discs 12, were machined from previously constructed logs to predetermined dimensions that would shrink to be slightly smaller than the inner diameter (ID) of the prefired green tubes 10 after firing of the discs at 1200° C. in air for about 120 minutes and sintering in 92% $N_2$-8% $H_2$ at 1850° C. for 1 minute. The fired discs 12 were then inserted into an end 14 of tube 10 to form a first assembly 16 (FIG. 3). The first assembly 16 was then sintered at 1950° C. for 30 minutes in dry $N_2$-8% $H_2$. This latter firing forms the polycrystalline alumina which may include a secondary spinel phase (as is known) and causes a 10–14% shrinkage in the diameter of tube 10 and forms a fritless, hermetic seal between the ID and the disc 12. Total transmittance of the tube was typically 95–96% and in-line transmittance was about 5–6%.

Figure 4:
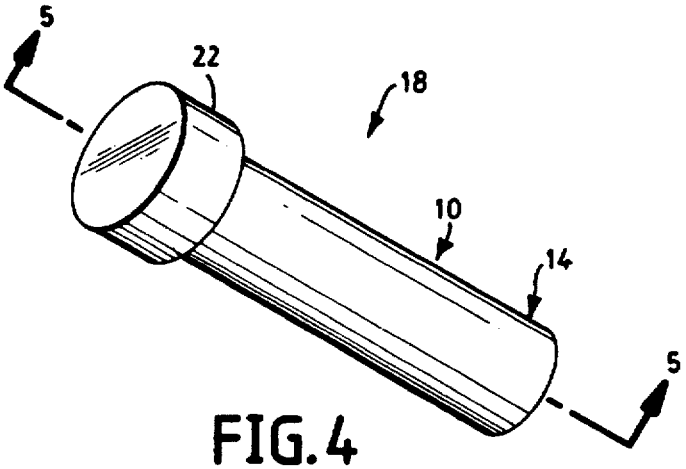
FIG. 4 is a perspective view of an embodiment of the invention.
Figure 5:
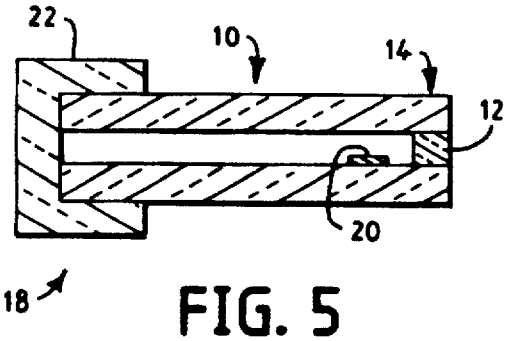
FIG. 5 is an elevational, sectional view taken along the line 5—5 of FIG. 4.

To form an arc tube 18 (FIG. 4), a predetermined mount of desired fill material is placed in the tube, preferably in the form of a pellet 20, and a prefired PCA hat 22, also containing 0.08 weight percent MgO, is placed over the open end of tube 10 to form a second assembly. The second assembly is placed in a furnace containing a suitable atmosphere and heated rapidly to about 1800° C. to form a fritless seal due to the hat 22 shrinking about 12–18% against the previously sintered and pre-shrunk tube 10.

The hat 22 was machined from a prefired PCA log to fit the dimensions of the fully sintered tube 10.

Figure 7:
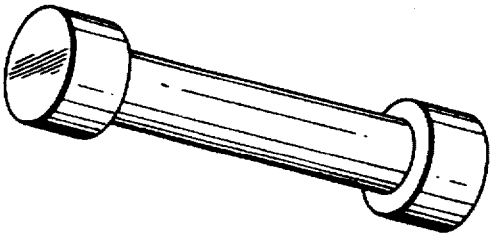
FIG. 7 is a perspective view of yet another embodiment of the invention.

An alternate embodiment is shown in FIG. 7 wherein hat shaped pieces 22 are used to seal both ends of tube 10. The logs in each instance were made from PCA powder doped with 0.08% MgO which had been isopressed at 12.5 ksi. These logs were then prefired at 1200° C. for 2 hours. In one example, the hats 22 had an overall length of 0.320", had an outside diameter (OD) of 0.410", and ID of 0.295", and were 0.200" deep. The gap between the prefired hat ID and the sintered tube OD was about 0.012". This gap is closed during the sealing operation.

Figure 6:
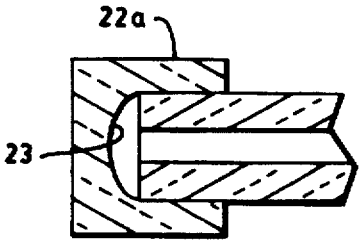
FIG. 6 is a partial, elevational, sectional view of an alternate embodiment of the invention.

In another alternate embodiment of the invention, the hats 22a (FIG. 6) have a concave bottom 23 to eliminate the tendency of cracking at the inside corners of the hat due to the hoop tension induced by the 12–18% differential shrinkage between the hat and the tube during sealing. The concave geometry changes the direction of the tensile force in the hat during sealing so as to eliminate cracking. The heating schedule for the formation of direct seals typically calls for heating from room temperature to about 1800° C. in about 1.5 to 3 minutes, holding at about 1800° C. for about 1 minute, and cutting off the furnace element power and cooling to room temperature in about 1.5 hours. The fast heating and short hold are necessary to keep the temperature at the previously sealed end of the lamp low so as not to volatilize the fill, especially the mercury.

Figure 8:
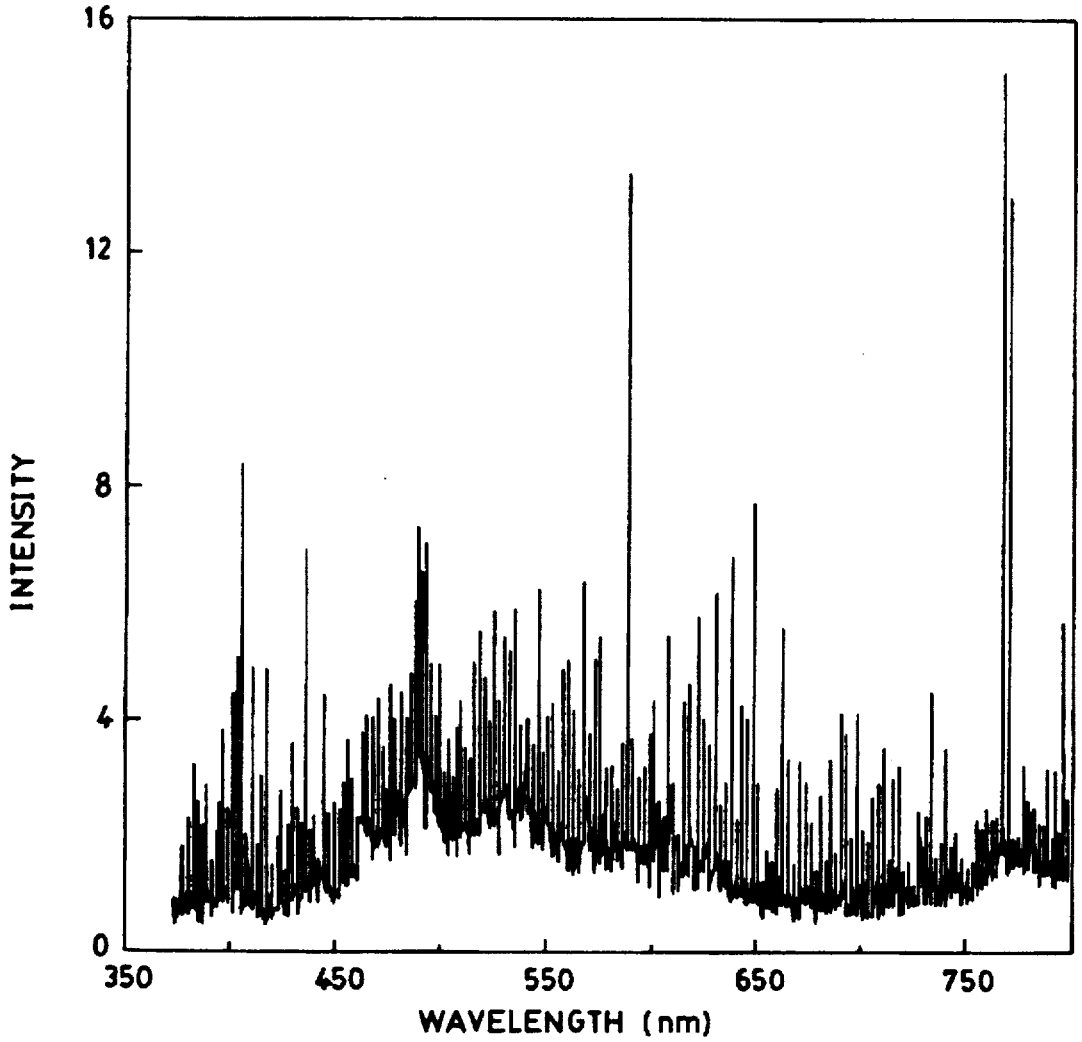
FIG. 8 is a graph of the spectrum of an excited lamp.

In a preferred form of the invention, the fill comprises $NdI_3$, CsI, Hg and Xe which is sealed into the arc tube in the absense of water since the rare earth halides are extremely hygroscopic. Electrodeless lamps so made were excited in a dual-ended power applicator, such as that shown in U.S. Pat. No. 5,070,277, at 915 MHz, and the spectrum was dominated by rare earth emission lines as shown in FIG. 8.

Alternatively, PCA doped with $SiO_2$ or pure monocrystalline alumina (sapphire) can by employed as the arc tube material.

While there have been shown and described what are at present considered the preferred embodiments of the invention, it will be apparent to those skilled in the art that various changes and modifications can be made herein without departing from the scope of the invention as defined by the appended claims.

What is claimed is:

1. In the method of making an arc tube for an electrodeless lamp the steps comprising: forming from the group consisting esentially of polycrystalline alumina doped with 0.08 weight percent magnesium oxide, polycrystalline alumina doped with silicon dioxide, or monocrystalline alumina, a green arc chamber having a substantially tubular configuration; prefiring said green arc chamber at about 1350° C. for about 120 minutes; forming a sealing disc to fit inside one end of said arc chamber, said sealing disc being formed from polycrystalline alumina doped with 0.08 weight percent magnesium oxide; firing said disc at 1200° C. for about 120 minutes and sintering said disc at 1850° C. for about one minute; inserting said sintered disc into an end of said arc chamber to form a first assembly and sintering said first assembly at 1950° C. for about 30 minutes in an inert atmosphere to form an hermetic seal between said arc chamber and said disc; forming from polycrystalline alumina doped with 0.08 weight percent magnesium oxide an end cap for an open end of said arc chamber, said end being cup-shaped and having an inside diameter which is formed to fit over an outside diameter of said arc chamber; prefiring said end cap at 1200° C. for about 120 minutes; introducing an arc generating and sustaining fill into said arc chamber; fitting said end cap over said open end of said arc chamber to form a second assembly; and rapidly heating said second assembly to about 1800° C. to form an interference-fit, hermetic bond between said end cap and said arc chamber.

* * * * *